US007934352B1

(12) United States Patent
Mollinger et al.

(10) Patent No.: US 7,934,352 B1
(45) Date of Patent: May 3, 2011

(54) GROOVED FOAM BACKED PANELS

(75) Inventors: Paul J. Mollinger, Blacklick, OH (US); Paul R. Pelfrey, Wheelersburg, OH (US)

(73) Assignee: Exterior Portfolio, LLC, Columbus, OH (US)

( * ) Notice: Subject to any disclaimer, the term of this patent is extended or adjusted under 35 U.S.C. 154(b) by 99 days.

(21) Appl. No.: 11/953,848

(22) Filed: Dec. 10, 2007

Related U.S. Application Data

(63) Continuation of application No. 10/688,750, filed on Oct. 17, 2003, now abandoned.

(51) Int. Cl.
*E04B 1/00* (2006.01)

(52) U.S. Cl. ..... 52/748.1; 52/556; 52/545

(58) Field of Classification Search ..... 52/309.8, 52/545, 556, 309.4, 236.3, 748.1
See application file for complete search history.

(56) References Cited

U.S. PATENT DOCUMENTS

| | | | | |
|---|---|---|---|---|
| 1,589,675 | A | | 6/1926 | Belding |
| 1,728,934 | A | | 9/1929 | Hogenson |
| 1,871,887 | A | | 8/1932 | Jasinski |
| 1,886,363 | A | | 11/1932 | Aufderheide |
| 1,888,417 | A | | 11/1932 | Aberson |
| 1,958,572 | A | | 5/1934 | Gilchrist |
| 2,094,688 | A | | 10/1937 | Wallace et al. |
| 2,115,172 | A | | 4/1938 | Kirschbraun |
| 2,130,911 | A | | 9/1938 | Teunon |
| 2,151,220 | A | | 3/1939 | Mattes |
| 2,246,377 | A | | 6/1941 | Mattes |
| 2,282,462 | A | | 5/1942 | Snyder |
| 2,305,280 | A | | 12/1942 | Strunk et al. |
| 2,308,789 | A | * | 1/1943 | Stagg ..... 52/478 |
| 2,317,926 | A | | 4/1943 | Lindahl |
| 2,618,815 | A | | 11/1952 | Iezzi |
| 2,660,217 | A | | 11/1953 | Lawson |
| 2,830,546 | A | | 4/1958 | Rippe |
| 2,961,804 | A | | 11/1960 | Beckman |
| D196,230 | S | | 9/1963 | Raftery et al. |
| 3,110,130 | A | * | 11/1963 | Trachtenberg ..... 52/545 |
| 3,159,943 | A | | 12/1964 | Sugar et al. |
| 3,233,382 | A | | 2/1966 | Graveley, Jr. |
| 3,246,436 | A | | 4/1966 | Roush |
| 3,289,365 | A | | 12/1966 | McLaughlin et al. |
| 3,289,380 | A | | 12/1966 | Chamiga, Jr. |
| 3,325,952 | A | | 6/1967 | Trachtenberg |

(Continued)

FOREIGN PATENT DOCUMENTS

| | | | |
|---|---|---|---|
| CA | 2203720 | A1 | 10/1998 |

(Continued)

OTHER PUBLICATIONS

Dupont Dow, "Adhesives", web site print outs from www.dupontdow.com, 1999, printed Aug. 12, 2000, 3 pages.

(Continued)

*Primary Examiner* — Basil Katcheves
(74) *Attorney, Agent, or Firm* — Standley Law Group LLP

(57) ABSTRACT

A backed paneling unit providing a drainage pathway for liquids that might be behind the backing portion of the paneling unit. The paneling unit facilitates the drainage of liquid from behind the panel by providing grooves that are typically connected so as to allow the drainage to occur from behind a series of adjacent installed panels. Additional grooves are provided to provide alternative drainage pathways for a liquid in the event that at least a portion of a groove is obstructed.

24 Claims, 8 Drawing Sheets

U.S. PATENT DOCUMENTS

| | | | | |
|---|---|---|---|---|
| D208,251 | S | | 8/1967 | Facer |
| 3,387,418 | A | | 6/1968 | Tyrer |
| 3,399,916 | A | | 9/1968 | Ensor |
| 3,468,086 | A | | 9/1969 | Warner |
| 3,473,274 | A | | 10/1969 | Godes |
| 3,520,099 | A | | 7/1970 | Mattes |
| 3,552,078 | A | | 1/1971 | Mattes |
| 3,555,762 | A | | 1/1971 | Costanzo, Jr. |
| 3,616,103 | A | | 10/1971 | Greiner et al. |
| 3,637,459 | A | | 1/1972 | Parish et al. |
| 3,703,795 | A | | 11/1972 | Mattes |
| 3,800,016 | A | | 3/1974 | Roberts |
| 3,815,310 | A | | 6/1974 | Kessler |
| 3,826,054 | A | * | 7/1974 | Culpepper, Jr. ..... 52/309.8 |
| 3,940,528 | A | | 2/1976 | Roberts |
| 3,969,866 | A | | 7/1976 | Kyne |
| 3,970,502 | A | | 7/1976 | Turner |
| 3,998,021 | A | | 12/1976 | Lewis |
| 4,001,997 | A | | 1/1977 | Saltzman |
| 4,033,802 | A | | 7/1977 | Culpepper, Jr. et al. |
| 4,034,528 | A | | 7/1977 | Sanders et al. |
| 4,048,101 | A | | 9/1977 | Nakamachi et al. |
| 4,081,939 | A | | 4/1978 | Culpepper, Jr. et al. |
| 4,096,011 | A | | 6/1978 | Sanders et al. |
| 4,102,106 | A | | 7/1978 | Golder et al. |
| 4,104,841 | A | | 8/1978 | Naz |
| 4,109,041 | A | * | 8/1978 | Tellman ..... 428/147 |
| 4,118,166 | A | | 10/1978 | Bartrum |
| 4,154,040 | A | | 5/1979 | Pace |
| 4,181,286 | A | | 1/1980 | Van Doren |
| 4,188,762 | A | | 2/1980 | Tellman |
| 4,189,885 | A | | 2/1980 | Fritz |
| 4,241,554 | A | | 12/1980 | Infantino |
| 4,272,576 | A | | 6/1981 | Britson |
| 4,274,236 | A | | 6/1981 | Kessler |
| 4,275,540 | A | | 6/1981 | Keller |
| 4,279,106 | A | | 7/1981 | Gleason et al. |
| 4,299,069 | A | | 11/1981 | Neumann |
| 4,319,439 | A | | 3/1982 | Gussow |
| 4,320,613 | A | | 3/1982 | Kaufman |
| 4,327,528 | A | | 5/1982 | Fritz |
| 4,352,771 | A | | 10/1982 | Szabo |
| 4,389,824 | A | | 6/1983 | Anderson |
| 4,424,655 | A | | 1/1984 | Trostle |
| 4,429,503 | A | | 2/1984 | Holliday |
| 4,450,665 | A | | 5/1984 | Katz |
| D274,947 | S | | 7/1984 | Culpepper, Jr. et al. |
| 4,492,064 | A | | 1/1985 | Bynoe |
| 4,506,486 | A | | 3/1985 | Culpepper, Jr. et al. |
| 4,593,512 | A | | 6/1986 | Funaki |
| 4,608,800 | A | | 9/1986 | Fredette |
| 4,649,008 | A | | 3/1987 | Johnstone et al. |
| 4,680,911 | A | | 7/1987 | Davis et al. |
| D291,249 | S | | 8/1987 | Manning |
| 4,694,628 | A | | 9/1987 | Vondergoltz et al. |
| 4,709,519 | A | | 12/1987 | Liefer et al. |
| 4,716,645 | A | | 1/1988 | Pittman et al. |
| 4,782,638 | A | | 11/1988 | Hovind |
| 4,814,413 | A | | 3/1989 | Thibaut et al. |
| 4,843,790 | A | | 7/1989 | Taravella |
| 4,856,975 | A | | 8/1989 | Gearhart |
| 4,864,788 | A | | 9/1989 | Tippmann |
| 4,911,628 | A | | 3/1990 | Heilmayr et al. |
| 4,920,709 | A | | 5/1990 | Garries et al. |
| 4,930,287 | A | | 6/1990 | Volk et al. |
| 4,955,169 | A | | 9/1990 | Shisko |
| 4,962,622 | A | | 10/1990 | Albrecht et al. |
| 4,969,302 | A | | 11/1990 | Coggan et al. |
| D316,299 | S | | 4/1991 | Hurlburt |
| 5,016,415 | A | | 5/1991 | Kellis |
| 5,022,204 | A | | 6/1991 | Anderson |
| 5,022,207 | A | | 6/1991 | Hartnett |
| 5,024,045 | A | | 6/1991 | Fluent et al. |
| 5,050,357 | A | | 9/1991 | Lawson |
| 5,060,444 | A | | 10/1991 | Paquette |
| 5,080,950 | A | | 1/1992 | Burke |
| 5,090,174 | A | | 2/1992 | Fragale |
| 5,103,612 | A | | 4/1992 | Wright |
| 5,173,337 | A | | 12/1992 | Nelson |
| 5,224,315 | A | | 7/1993 | Winter, IV |
| 5,230,377 | A | | 7/1993 | Berman |
| D342,579 | S | | 12/1993 | Mason |
| 5,282,344 | A | | 2/1994 | Moore |
| 5,283,102 | A | | 2/1994 | Sweet et al. |
| 5,303,525 | A | | 4/1994 | Magee |
| 5,306,548 | A | | 4/1994 | Zabrocki et al. |
| 5,318,737 | A | | 6/1994 | Trabert et al. |
| 5,347,784 | A | | 9/1994 | Crick et al. |
| 5,363,623 | A | | 11/1994 | King |
| 5,387,381 | A | | 2/1995 | Saloom |
| 5,415,921 | A | | 5/1995 | Grohman |
| 5,419,863 | A | | 5/1995 | Henderson |
| D361,138 | S | | 8/1995 | Moore et al. |
| 5,443,878 | A | | 8/1995 | Treloar et al. |
| 5,461,839 | A | | 10/1995 | Beck |
| 5,465,486 | A | | 11/1995 | King |
| 5,465,543 | A | | 11/1995 | Seifert |
| 5,475,963 | A | | 12/1995 | Chelednik |
| 5,482,667 | A | | 1/1996 | Dunton et al. |
| 5,502,940 | A | | 4/1996 | Fifield |
| 5,537,791 | A | | 7/1996 | Champagne |
| 5,542,222 | A | | 8/1996 | Wilson et al. |
| 5,548,940 | A | | 8/1996 | Baldock |
| 5,551,204 | A | | 9/1996 | Mayrand |
| 5,560,170 | A | | 10/1996 | Ganser et al. |
| 5,564,246 | A | | 10/1996 | Champagne |
| 5,565,056 | A | | 10/1996 | Lause et al. |
| 5,575,127 | A | | 11/1996 | O'Neal |
| 5,581,970 | A | | 12/1996 | O'Shea |
| 5,586,415 | A | | 12/1996 | Fisher et al. |
| 5,598,677 | A | | 2/1997 | Rehm, III |
| 5,613,337 | A | | 3/1997 | Plath et al. |
| 5,622,020 | A | | 4/1997 | Wood |
| 5,634,314 | A | | 6/1997 | Champagne |
| 5,651,227 | A | | 7/1997 | Anderson |
| 5,661,939 | A | | 9/1997 | Coulis et al. |
| 5,662,997 | A | | 9/1997 | Spain et al. |
| 5,664,376 | A | | 9/1997 | Wilson et al. |
| 5,675,955 | A | | 10/1997 | Champagne |
| 5,678,367 | A | | 10/1997 | Kline |
| 5,694,728 | A | | 12/1997 | Heath, Jr. et al. |
| 5,720,114 | A | | 2/1998 | Guerin |
| 5,729,946 | A | | 3/1998 | Beck |
| 5,737,881 | A | | 4/1998 | Stocksieker |
| 5,765,333 | A | | 6/1998 | Cunningham |
| 5,768,844 | A | | 6/1998 | Grace, Sr. et al. |
| 5,791,093 | A | | 8/1998 | Diamond |
| 5,806,185 | A | | 9/1998 | King |
| 5,809,731 | A | | 9/1998 | Reiss |
| 5,829,206 | A | | 11/1998 | Bachman |
| 5,836,113 | A | | 11/1998 | Bachman |
| D402,770 | S | | 12/1998 | Hendrickson et al. |
| 5,857,303 | A | | 1/1999 | Beck et al. |
| 5,858,522 | A | | 1/1999 | Turk et al. |
| 5,860,259 | A | | 1/1999 | Laska |
| 5,866,054 | A | | 2/1999 | Dorchester et al. |
| 5,866,639 | A | | 2/1999 | Dorchester et al. |
| 5,869,176 | A | | 2/1999 | Dorchester et al. |
| 5,878,543 | A | | 3/1999 | Mowery |
| 5,885,502 | A | | 3/1999 | DeAngelis et al. |
| 5,913,791 | A | | 6/1999 | Baldwin |
| 5,946,876 | A | | 9/1999 | Grace, Sr. et al. |
| 5,956,914 | A | | 9/1999 | Williamson |
| 5,974,756 | A | | 11/1999 | Alvarez et al. |
| 6,029,415 | A | | 2/2000 | Culpepper et al. |
| 6,035,587 | A | | 3/2000 | Dressler |
| 6,047,507 | A | | 4/2000 | Lappin et al. |
| 6,050,041 | A | | 4/2000 | Mowery et al. |
| 6,055,787 | A | | 5/2000 | Gerhaher et al. |
| 6,086,997 | A | | 7/2000 | Patel et al. |
| D429,009 | S | | 8/2000 | Ginzel |
| 6,122,877 | A | | 9/2000 | Hendrickson et al. |
| 6,132,669 | A | | 10/2000 | Valyi et al. |
| 6,161,354 | A | | 12/2000 | Gilbert et al. |
| 6,187,424 | B1 | | 2/2001 | Kjellqvist et al. |
| 6,195,952 | B1 | | 3/2001 | Culpepper et al. |
| 6,223,488 | B1 | | 5/2001 | Pelfrey et al. |

| | | | |
|---|---|---|---|
| 6,233,890 | B1 | 5/2001 | Tonyan |
| 6,263,574 | B1 | 7/2001 | Lubker, II et al. |
| 6,272,797 | B1 | 8/2001 | Finger |
| D447,820 | S | 9/2001 | Grace |
| 6,282,858 | B1 | 9/2001 | Swick |
| D448,865 | S | 10/2001 | Manning |
| 6,295,777 | B1 | 10/2001 | Hunter et al. |
| D450,138 | S | 11/2001 | Barber |
| 6,321,500 | B1 | 11/2001 | Manning et al. |
| 6,336,988 | B1 | 1/2002 | Enlow et al. |
| 6,348,512 | B1 | 2/2002 | Adriani |
| D454,962 | S | 3/2002 | Grace |
| 6,355,193 | B1 | 3/2002 | Stott |
| 6,358,585 | B1 | 3/2002 | Wolff |
| 6,360,508 | B1 | 3/2002 | Pelfrey et al. |
| 6,363,676 | B1 | 4/2002 | Martion, III |
| 6,367,220 | B1 | 4/2002 | Krause et al. |
| 6,393,792 | B1 | 5/2002 | Mowery et al. |
| 6,442,912 | B1 | 9/2002 | Phillips et al. |
| 6,516,577 | B2 | 2/2003 | Pelfrey et al. |
| 6,516,578 | B1 | 2/2003 | Hunsaker |
| D471,292 | S | 3/2003 | Barber |
| 6,526,718 | B2 | 3/2003 | Manning et al. |
| 6,539,675 | B1 | 4/2003 | Gile |
| 6,590,004 | B1 | 7/2003 | Zehner |
| 6,594,965 | B2 | 7/2003 | Coulton |
| 6,625,939 | B1 | 9/2003 | Beck et al. |
| D481,804 | S | 11/2003 | Pelfrey |
| 6,673,868 | B2 | 1/2004 | Choulet |
| 6,716,522 | B2 | 4/2004 | Matsumoto et al. |
| 6,726,864 | B2 | 4/2004 | Nasr et al. |
| 6,752,941 | B2 | 6/2004 | Hills |
| 6,784,230 | B1 | 8/2004 | Patterson et al. |
| 6,824,850 | B2 * | 11/2004 | Nourigat ..... 428/41.8 |
| 6,865,849 | B1 | 3/2005 | Mollinger et al. |
| 6,886,301 | B2 | 5/2005 | Schilger |
| 6,971,211 | B1 | 12/2005 | Zehner |
| 6,988,345 | B1 | 1/2006 | Pelfrey et al. |
| 7,040,067 | B2 | 5/2006 | Mowery et al. |
| 7,188,454 | B2 | 3/2007 | Mowery et al. |
| 7,204,062 | B2 | 4/2007 | Fairbanks et al. |
| 7,467,500 | B2 | 12/2008 | Fairbanks et al. |
| 2001/0041256 | A1 | 11/2001 | Heilmayr |
| 2002/0018907 | A1 | 2/2002 | Zehner |
| 2002/0020125 | A1 | 2/2002 | Pelfrey et al. |
| 2002/0025420 | A1 | 2/2002 | Wanat et al. |
| 2002/0029537 | A1 | 3/2002 | Manning et al. |
| 2002/0054996 | A1 | 5/2002 | Rheenen |
| 2002/0056244 | A1 | 5/2002 | Hertweck |
| 2002/0076544 | A1 | 6/2002 | DeWorth et al. |
| 2002/0078650 | A1 | 6/2002 | Bullinger et al. |
| 2002/0090471 | A1 | 7/2002 | Burger et al. |
| 2002/0092256 | A1 | 7/2002 | Hendrickson et al. |
| 2002/0108327 | A1 | 8/2002 | Shaw |
| 2002/0112427 | A1 | 8/2002 | Baldwin |
| 2002/0145229 | A1 | 10/2002 | Kuriger et al. |
| 2002/0177658 | A1 | 11/2002 | Tajima et al. |
| 2002/0189182 | A1 | 12/2002 | Record |
| 2003/0014936 | A1 | 1/2003 | Watanabe |
| 2003/0024192 | A1 | 2/2003 | Spargur |
| 2003/0056458 | A1 | 3/2003 | Black et al. |
| 2003/0131551 | A1 | 7/2003 | Mollinger et al. |
| 2003/0154664 | A1 | 8/2003 | Beck et al. |
| 2004/0003566 | A1 | 1/2004 | Sicuranza |
| 2004/0026021 | A1 | 2/2004 | Groh et al. |
| 2004/0142157 | A1 | 7/2004 | Melkonian |
| 2004/0182026 | A1 | 9/2004 | Clarke |
| 2004/0211141 | A1 | 10/2004 | Sandy |
| 2005/0064128 | A1 | 3/2005 | Lane et al. |
| 2005/0081468 | A1 | 4/2005 | Wilson et al. |
| 2005/0087908 | A1 | 4/2005 | Nasr et al. |
| 2006/0026920 | A1 | 2/2006 | Fairbanks et al. |
| 2006/0053740 | A1 | 3/2006 | Wilson et al. |
| 2006/0075712 | A1 | 4/2006 | Gilbert et al. |
| 2006/0123729 | A1 | 6/2006 | Myers et al. |
| 2006/0156668 | A1 | 7/2006 | Nasvik |
| 2006/0157634 | A1 | 7/2006 | Nasvik |
| 2006/0197257 | A1 | 9/2006 | Burt et al. |
| 2007/0227087 | A1 | 10/2007 | Nasr et al. |
| 2009/0056257 | A1 | 3/2009 | Mollinger et al. |
| 2009/0062413 | A1 | 3/2009 | Adur et al. |
| 2009/0062431 | A1 | 3/2009 | Nasr et al. |
| 2009/0068406 | A1 | 3/2009 | Race et al. |

FOREIGN PATENT DOCUMENTS

| | | | |
|---|---|---|---|
| CA | 2359639 | A1 | 4/2002 |
| CA | 96829 | | 8/2002 |
| CA | 2267000 | | 4/2003 |
| CL | 3.856 | | 5/2001 |
| DE | 40104760.1 | | 5/2001 |
| EP | 1086988 | A1 | 3/2001 |
| FR | 2538293 | A2 | 6/1984 |
| FR | 2627211 | A1 | 8/1989 |
| GB | 1068202 | | 5/1967 |
| GB | 2101944 | | 8/2001 |
| JP | 364001539 | A | 1/1989 |
| JP | 409141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | 00/55446 | A1 | 9/2000 |
| WO | 2009/100340 | A1 | 8/2009 |

OTHER PUBLICATIONS

Dupont Dow, "Neoprene—Grades of Neoprene—AquaStikTM Water Based Polychloroprene.", web site print outs from www.dupontdow.com, 1999, printed Aug. 12, 2000, 2 pages.

Dupont Dow, "Neoprene—Grades of Neoprene—Neoprene Solid Grades for Solvent-Based Adhesives.", web site print outs from www.dupontdow.com, publication date not available, printed Aug. 12, 2000, 2 pages.

Owens Corning, Innovations for Living, "What Do I Look For in Quality Vinyl Siding?", 1996-2002, printed Nov. 9, 2002, 1 page.

Feirer, Mark, "Vinyl Siding, Love it or hate it, plastic is here to stay," This Old House Online, 2003, 8 pages The Time4 Media Company.

Concrete Accessories & Rentals, Inc., "Stucco & EIFS line", web site print outs from www.concreteacc.com/eifs.asp, Jan. 5, 2005, printed May 30, 2006, 3 pages.

Finnemore, Melody, "A Growing Problem, Mold, water damage and accompanying litigation hamper building industry", web site print outs from www.construction.com/NewsCenter/Headlines/RP/20040901nw-1.asp, 2006, printed May 30, 2006, 3 pages, The McGraw-Hill Companies, Inc.

Raylite, web site print outs from www.diversifoam.com/raylite.htm, publication date not available, printed May 30, 2006, 3 pages.

Insulation Technology, Inc. web site print outs from www.insultech-eps.com, publication date not available, printed May 30, 2006, 10 pages.

Sweet's General Building & Renovation, 1995 Catalog File; section 07460 on Siding, pp. 4-20.

Dupont Dow, web site print outs from www.dupontdow.com, "Adhesives," Aug. 12, 2000, 3 pages.

Dupont Dow, web site print outs from www.dupontdow.com, "Neoprene—Grades of Neoprene—AquaStikTM Water Based Polychloroprene." Aug. 12, 2000, 2 pages.

Dupont Dow, web site print outs from www.dupontdow.com, "Neoprene—Grades of Neoprene—Neoprene Solid Grades for Solvent-Based Adhesives." Aug. 12, 2000, 2 pages.

Crane Performance Siding, "New Craneboard solid core siding redefines home exterior siding," news release online, Mar. 20, 2001, 3 pages.

Weiker, Jim, "Crane puts new face on siding," The Columbus Dispatch, May 9, 2002, 3 pages.

Owens Corning, Innovations for Living, "What Do I Look For in Quality Vinyl Siding?", Nov. 9, 2002, 1 page.

Building Products, Crane in the News, International Builder's Show Preview, Jan./Feb. 2003, 1 page.

Feirer, Mark, "Vinyl Siding, Love it or hate it, plastic is here to stay," This Old House Online, no date, 8 pages.

* cited by examiner

GROOVED FOAM BACKED PANELS

This is a continuation of U.S. application Ser. No. 10/688,750, filed Oct. 17, 2003, which is hereby incorporated by reference in its entirety.

BACKGROUND AND SUMMARY OF THE INVENTION

This application incorporates by reference U.S. Pat. No. 6,321,500 and presently pending U.S. patent application Ser. No. 10/447,896, filed on May 29, 2003, as background for the present application.

The present invention relates generally to grooved foam backed panels for building structures. Examples of panels that may benefit from the present invention include siding panels, wall panels, and other similar, suitable, or conventional types of panels. In the event that a liquid, such as condensation or rainwater, was to accumulate or get behind a foamed backed panel of the present invention; the liquid should be allowed to drain away. The present invention provides a drainage pathway for a liquid on a surface of a backing portion of a paneling unit.

In order to enhance the thermal insulation of building structures, it is known to provide one or more layers or panels of insulating material between the vinyl facing panel and the building structure. The backing may also improve the structural characteristics of the siding panel. Known insulated siding systems exist in many different forms. For instance, it is known to nail large sheets of insulating material to the building structure and then install the siding over the insulating material. Another system places a panel of insulation material in a slot behind the vinyl facing panel. Yet another system pours foam filler into the back of a vinyl facing panel such that the foam filler conforms to the geometry of the vinyl facing panel.

The present invention provides a drainage pathway, comprised of grooves, for a liquid on a surface of a backing portion of a paneling unit. Typical installations of the present invention include paneling units generally installed vertically so that a generally downwardly oriented plurality of drainage grooves allows a liquid to drain. Preferred embodiments of the present invention also comprise connector grooves that intersect at least two of the plurality of drainage grooves. As a result, alternative drainage pathways are provided in the system of preferably hydraulically connected drainage grooves and connector grooves.

In addition, the present invention may provide for an orientation of the grooves on the surface of a backing portion of a paneling unit of the present invention so that adjacent, substantially similar paneling units installed with the paneling unit may have at least a portion of the plurality of drainage grooves to be part of a segment of a continuous drainage groove. In this manner, a liquid may drain from the surfaces of the backing portions of the installed paneling units through an interconnected system of continuous drainage grooves. Additionally, the present invention may provide for at least one connector groove on a surface of a backing portion of a paneling unit to form at least a segment of a continuous connector groove with adjacent, substantially similar installed paneling units. As discussed above, the continuous grooves between adjacent panels may facilitate the drainage of liquid from the surfaces of the backing portions of the installed paneling units.

The present invention is an improvement over each of the aforementioned systems. An exemplary embodiment of the present invention provides a siding unit, which is comprised of backing and a facing panel. The advantages of the backed siding may include improved energy efficiency, reduced air infiltration, reduced curvature in the siding panels, and increased ease of installation. One embodiment of the backed siding of the present invention has improved interlocking pieces and an improved backing. Chemicals may be added to the backing that aid in the reduction or repelling of insects such as carpenter ants and termites.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
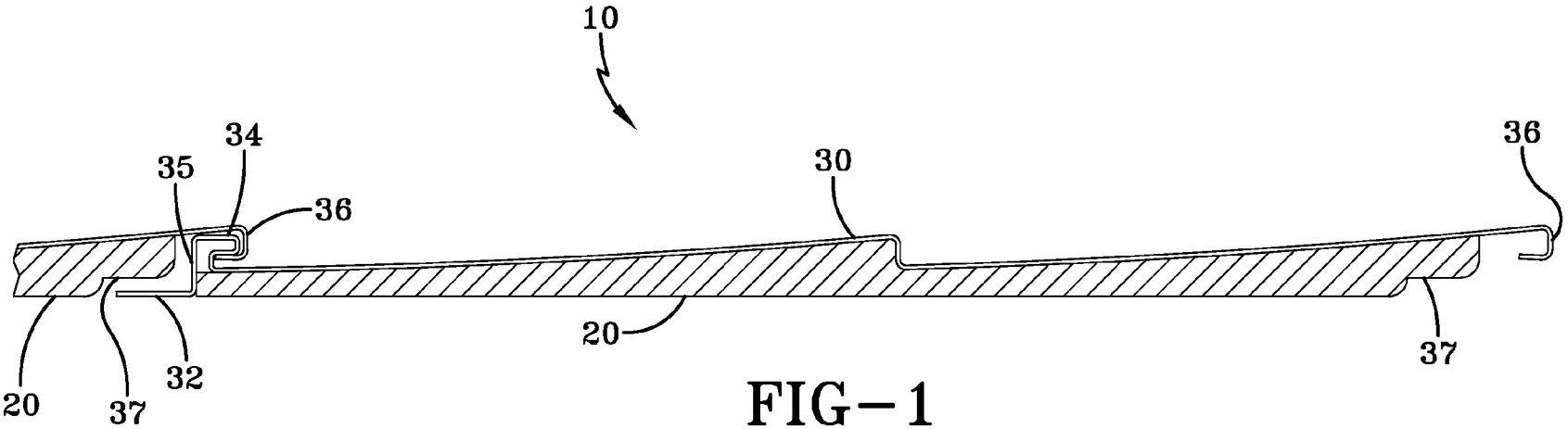
FIG. 1 is a side elevation view of an assembly including a first exemplary embodiment of a backed siding unit according to the present invention.
Figure 2:
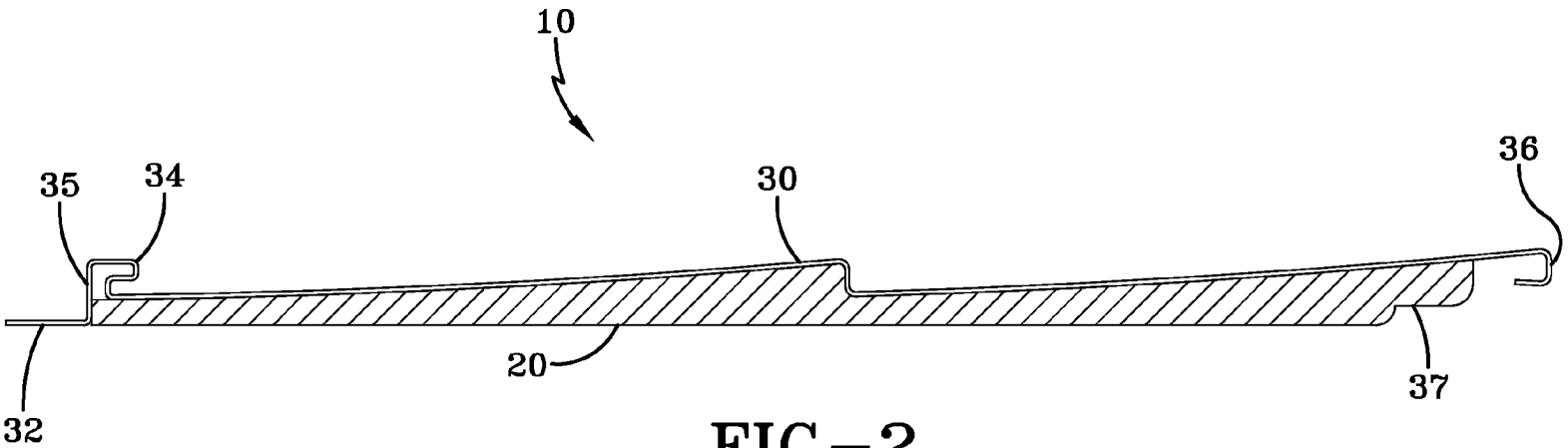
FIG. 2 is a side elevation view of the siding unit shown in FIG. 1.

The present invention is directed to a backed paneling unit. FIGS. 1 through 11 illustrate exemplary embodiments of a paneling unit of the present invention. FIGS. 1 and 2 show a siding unit 10 with two rows of siding. Nevertheless, it should be understood that a paneling unit of the present invention may be manufactured with any desired number of rows.

In FIGS. 1 and 2, the siding unit 10 includes backing portion 20 and at least one facing or cover panel or portion 30. For example, the backing portion 20 may be comprised of a base of either expanded or extruded polystyrene foam. However, it should be recognized that the backing portion 20 may be comprised of any sufficiently rigid material, including, but not limited to, foam, fiberglass, cardboard, and other similar, suitable, or conventional materials. Any suitable means may be used to obtain the shape of the backing portion 20. In an exemplary embodiment, the shape of the backing portion 20 may be obtained by extrusion through a predetermined die configuration and/or by cutting such as with a power saw or other cutting devices.

The backing portion 20 may be glued or otherwise laminated to the inside of the cover panel 30. For example, an adhesive may be used to bond a portion of a backed portion 20 to a portion of the inside of a facing panel 30.

In addition, the facing portion 30 may include an attachment strip 32 (e.g., a nailing strip), a tongue 34, and a groove 36. The facing panel 30 of the present invention has a portion 35 that rearwardly extends to attachment strip 32. The portion 35, alone or in combination with attachment strip 32, substantially covers the end or tip of the backing portion 20. More particularly, the portion 35 wraps around and abuts or is substantially adjacent to the end or tip of the backing portion 20. As a result, the portion 35 protects the end or tip of the backing portion 20 from damage, particularly during shipping and installation. In this example, the attachment strip 32 is substantially in the same plane and parallel to an adjacent portion of the rear side of the backing portion 20. A channel 37 on the bottom portion of the backing portion 20 may be adapted to interlock with, overlap, and/or extend over the nailing strip 32 of the facing panel 30 of a substantially similar siding unit 10. The nailing strip (also called a nailing hem) 32 may have a plurality of openings for receiving fasteners. Nails or any other suitable mechanical fastening means may be extended through apertures in the nailing strip 32 in order to secure the facing panel 30 to a building structure. As is shown in FIG. 1, the tongue 34 is adapted to fit in the groove 36 of another siding panel when installed on a building structure. Likewise, the groove 36 is adapted to receive the tongue 34 of a substantially similar siding panel when installed on a building structure. The tongue-and-groove connection may also be referred to as a hanger section.

The top or face portion of the siding unit 10 may have a facing panel 30, which completely covers the backing portion 20. A benefit of this feature is that the backing portion 20 is protected from breakage that may occur in shipping, handling, or installation if not substantially covered with a facing panel 30.

Figure 3:
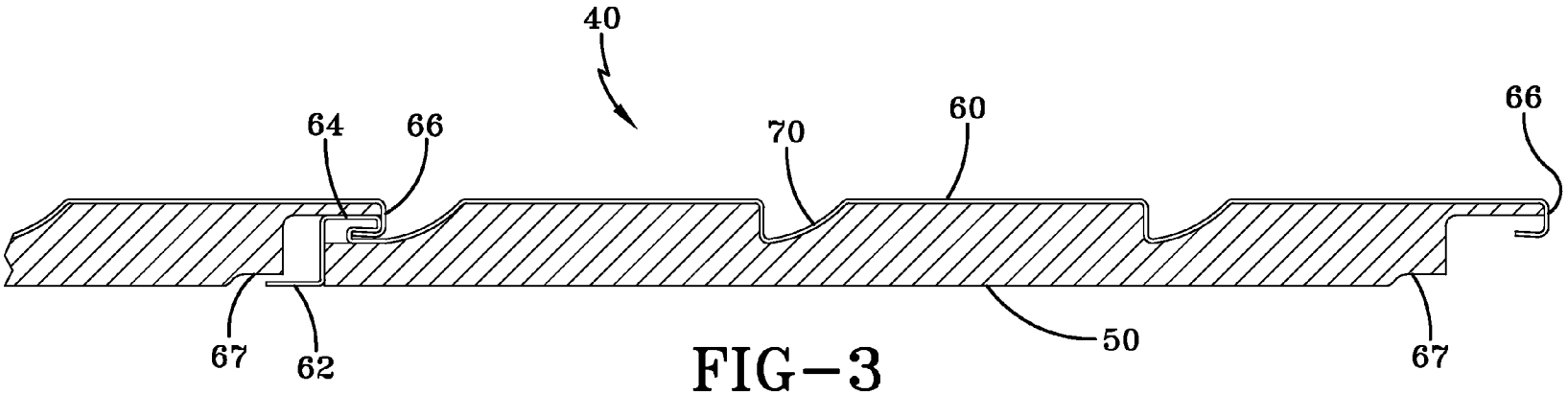
FIG. 3 is a side elevation view of an assembly including a second exemplary embodiment of a siding unit of the present invention.

FIG. 3 shows an embodiment of a siding unit 40 in which the backing portion 50 extends into the groove 66. The tongue 64 is adapted to fit into the groove 66 of an adjacent siding unit. The unit also has a nailing hem 62, which may or may not have an aperture for fastening the siding unit down. A channel 67 on the bottom portion of the backing portion 50 is adapted to interlock with, overlap, and/or cover the nailing strip 62 of the facing panel 60 of a substantially similar siding unit 40.

In FIGS. 3 through 6, the facing panels 60, 100, 140, and 180, respectively, have flat top surfaces that are substantially parallel to the structure on which the paneling unit is adapted to be installed. In these examples, the facing panels have regularly space indentures or recessed portions 70, 110, 150, and 190, respectively.

Figure 4:
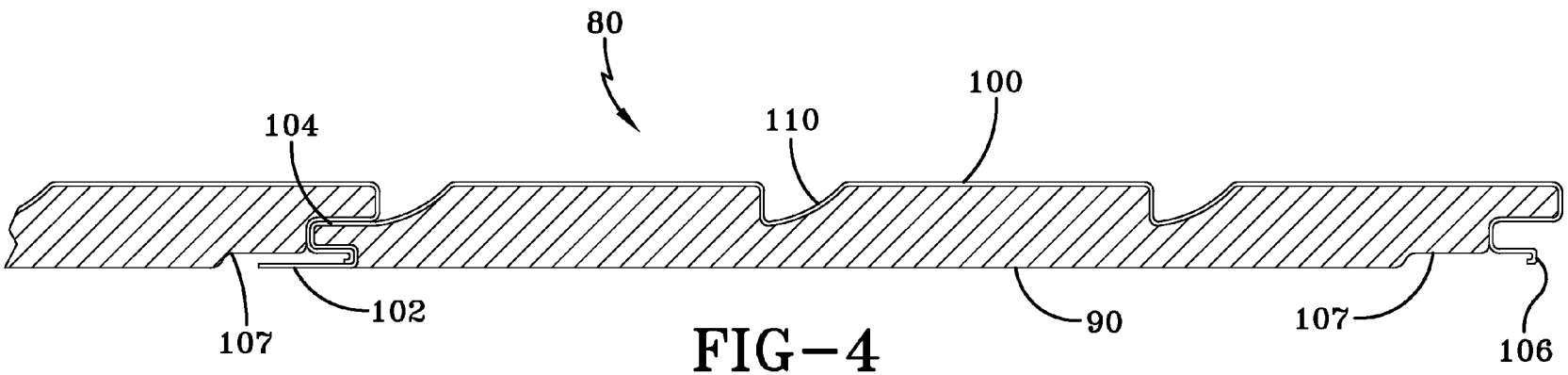
FIG. 4 is a side elevation view of an assembly including a third exemplary embodiment of a siding unit of the present invention.

FIG. 4 shows an embodiment of the present invention. The siding unit 80 has a backing portion 90 and a facing panel 100. The facing panel 100 includes an attachment strip or hem 102, a tongue 104, and a groove 106. In this embodiment, the facing panel 100 substantially covers the top end or tip and the bottom end or tip of the backing portion 90. The tongue 104 extends around and abuts or is substantially adjacent to the top end or tip of the backing portion 90. Also, the groove 106 wraps around and abuts or is substantially adjacent to the bottom end or tip of the backing portion 90. A terminal portion of the groove 106 extends away from a channel 107 on the rear side of the bottom portion of the backing portion 90. The channel 107 may be adapted to interlock with, overlap, and/or extend over the nailing strip 102 of the facing panel 100 of a substantially similar siding unit 80. The channel 107 may provide a sufficient amount of clearance for the top of a mechanical fastener such as a nail, which may extend through the nailing strip 102 of an adjacent siding unit 80.

Figure 5:
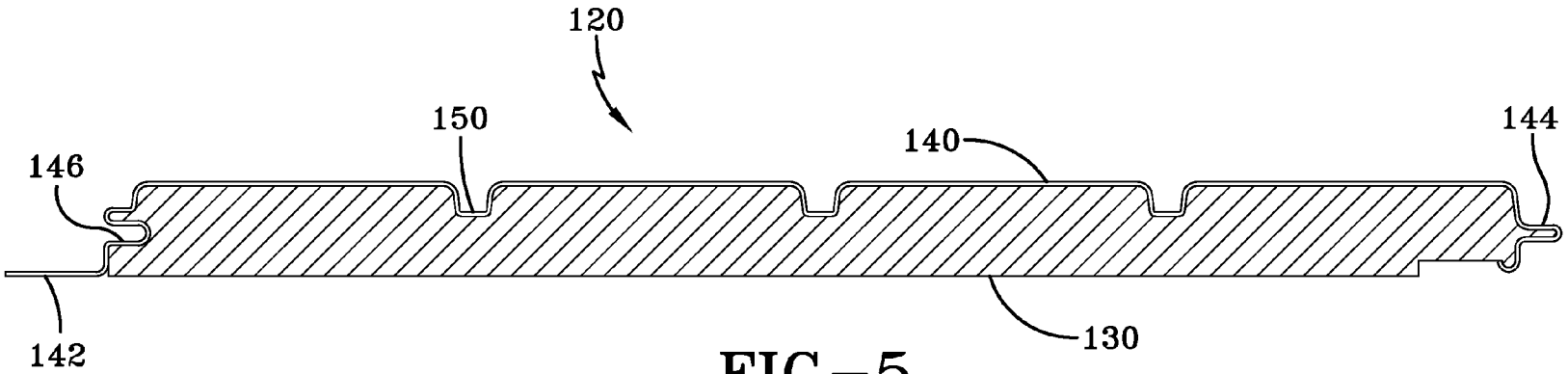
FIG. 5 is a side elevation view of an exemplary embodiment of a wall panel unit of the present invention.

FIG. 5 represents an exemplary embodiment of a wall panel unit 120 of the present invention. The paneling unit 120 has a backing portion 130 and a facing panel 140. The facing panel 140 includes an attachment strip or hem 142, a tongue 144, and a groove 146. This embodiment of the facing panel 140 also substantially covers the top end or tip and the bottom end or tip of the backing portion 130. In this example, the tongue 144 extends around and abuts or is substantially adjacent to the bottom end or tip of the backing portion 130, and the groove 146 wraps around and abuts or is substantially adjacent to the top end or tip of the backing portion 130. A terminal portion of the facing panel 140 may extend around the bottom end or tip of the backing portion 130 and into a channel on the rear side of the bottom portion of the backing portion 130. The channel may be adapted to interlock with, overlap, and/or extend over the nailing strip 142 of the facing panel 140 of a substantially similar paneling unit 120. The channel may provide a sufficient amount of clearance for the top of a mechanical fastener such as a nail, which may extend through the nailing strip 142 of an adjacent paneling unit 120.

Figure 6:
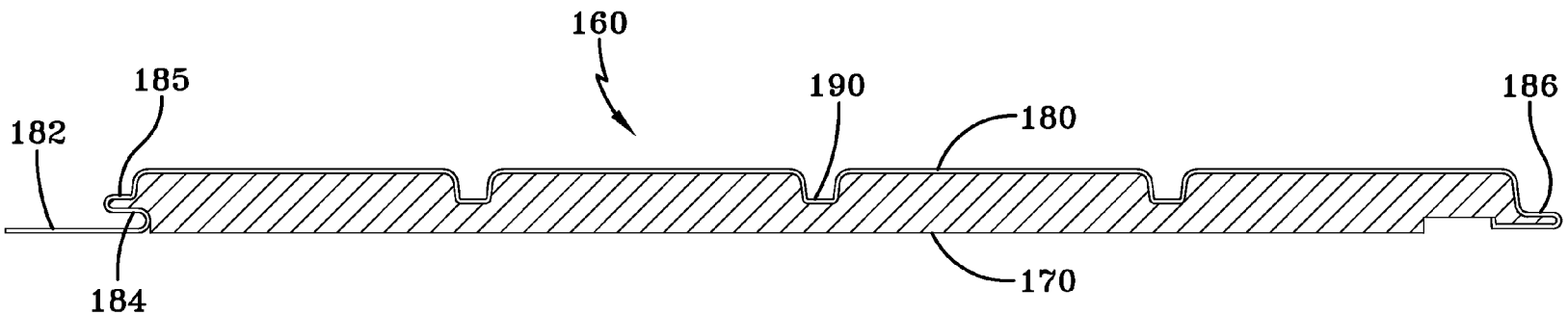
FIG. 6 is a side elevation view of another exemplary embodiment of a wall panel unit of the present invention.

FIG. 6 shows an embodiment of a paneling unit 160 of the present invention. The paneling unit 160 has a backing portion 170 and a facing panel 180. The facing panel 180 includes an attachment strip or hem 182, a groove 184, a tongue 185, and another tongue 186. This is another embodiment in which the facing panel 180 substantially covers the top end or tip and the bottom end or tip of the backing portion 170. In this example, the groove 184 is formed between the nailing strip 182 and the tongue 185. Both the groove 184 and the tongue 185 abut or are substantially adjacent to the top end or tip of the backing portion 170. On the other hand, the tongue 186 extends around and abuts or is substantially adjacent to the bottom end or tip of the backing portion 170. As shown in the example, a channel may be formed on the rear side of the bottom portion of the backing portion 170. The channel may be adapted to interlock with, overlap, and/or extend over the nailing strip 182 of the facing panel 180 of a substantially similar paneling unit 160. The channel may provide a sufficient amount of clearance for the top of a mechanical fastener such as a nail, which may extend through the nailing strip 182 of an adjacent paneling unit 160. Optionally, the facing panel 180 may extend around the bottom end or tip of the backing portion 130 and into the channel.

Figure 7:
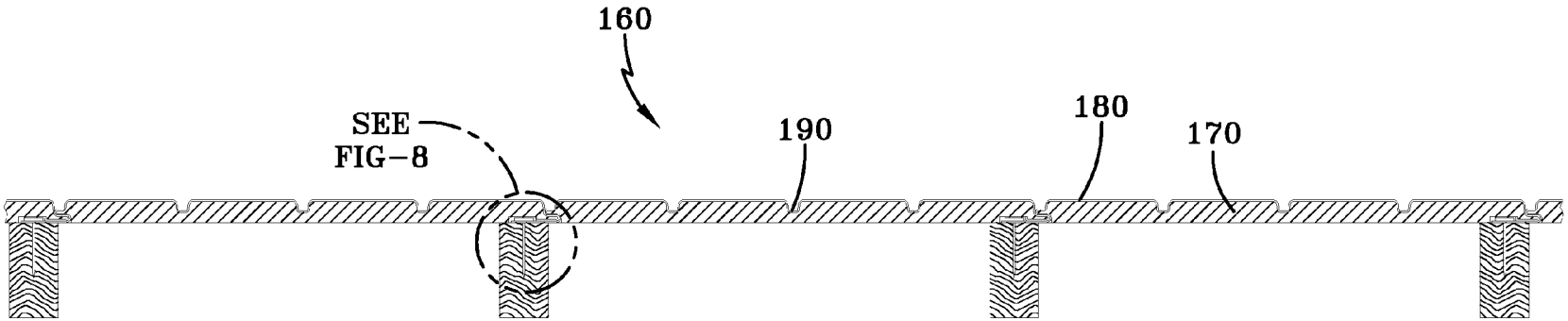
FIG. 7 is a side elevation view of an assembly of paneling units of FIG. 6.
Figure 8:
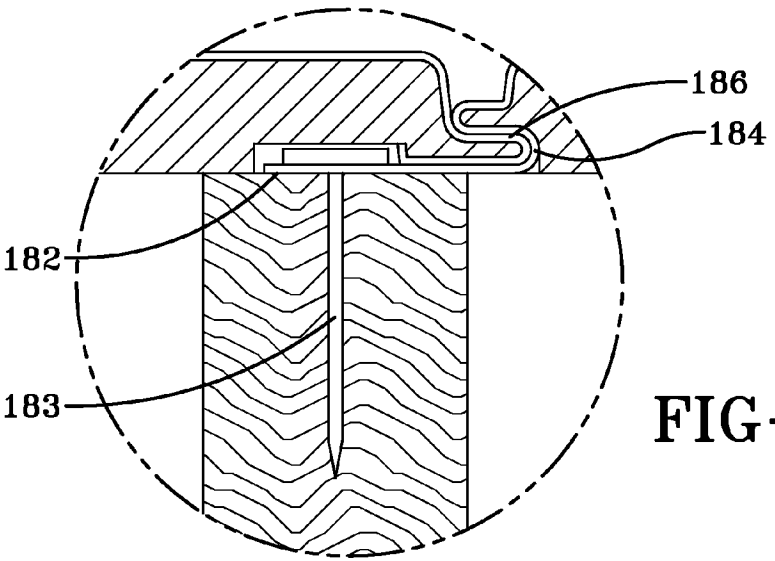
FIG. 8 is a side elevation view of a designated portion of FIG. 7.

The paneling unit of FIG. 6 is adapted to be connected to adjacent, substantially similar paneling units as shown in FIG. 7. A designated portion of FIG. 7 is shown in FIG. 8. The tongue 186 of one paneling unit is situated in the groove 184 of an adjacent paneling unit. A fastener 183 is shown in an aperture of the nailing strip or hem 182.

Figure 9:
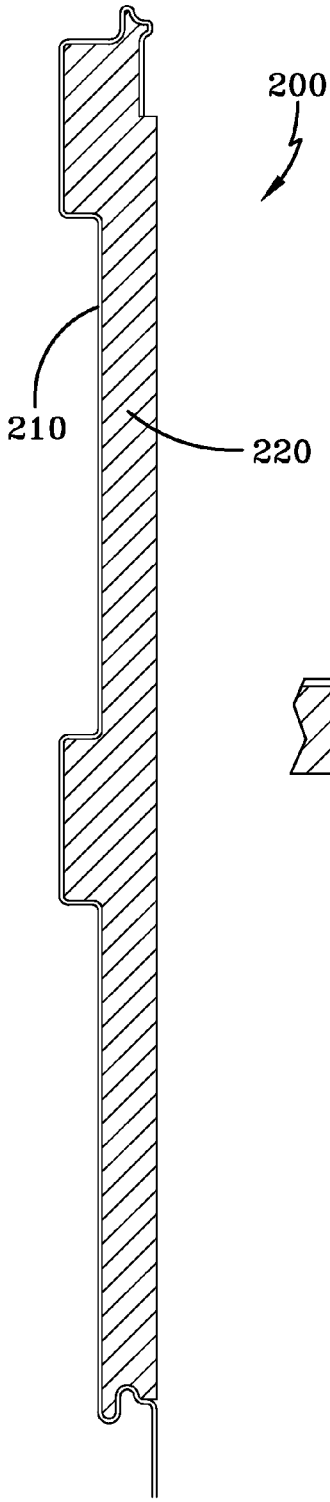
FIG. 9 is a side elevation view of a third exemplary embodiment of a wall panel unit of the present invention.
Figure 10:
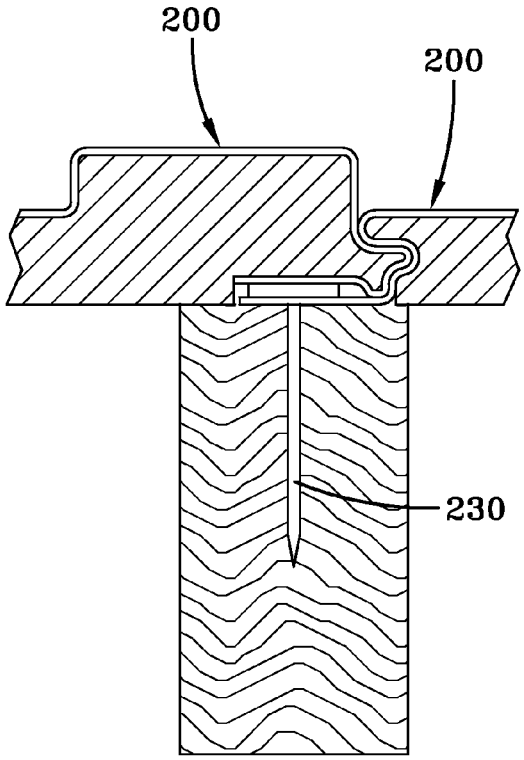
FIG. 10 is a partial side elevation view of an assembly including the paneling units shown in FIG. 9.
Figure 11:
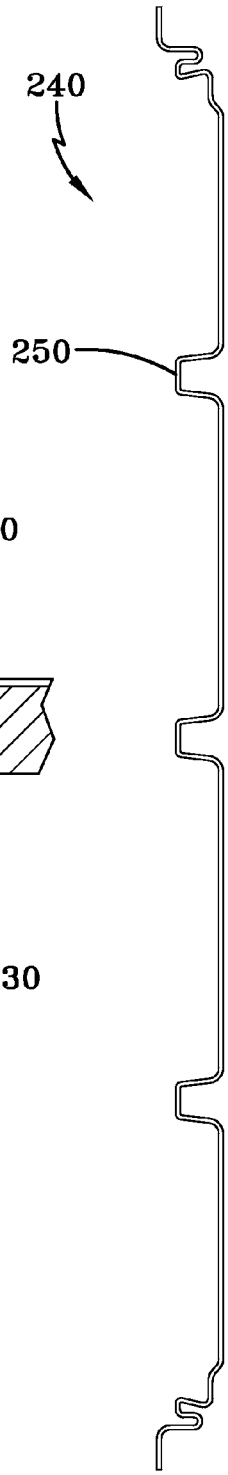
FIG. 11 is a side elevation view of a fourth exemplary embodiment of a wall panel unit of the present invention.

FIGS. 9 through 11 illustrate some other embodiments of paneling units of the present invention that include some or all of the aforementioned features. FIG. 9 shows a wall panel unit 200 that is comprised of a facing panel 210 and a backing portion 220. FIG. 10 shows a fastener 230 connecting adjacent paneling units 200 together. A wall panel unit 240 comprising a facing panel 250 is shown in FIG. 11. It should be recognized that the wall panel unit 240 may include a backing portion. However, it should also be recognized that some embodiments of paneling units of the present invention may not include a backing portion.

Figure 12A:
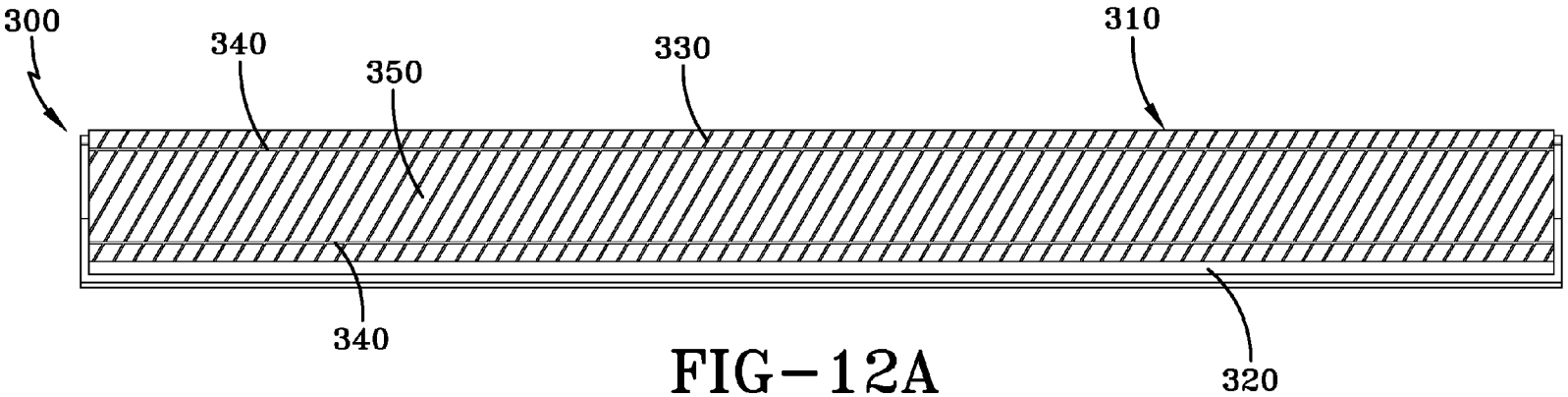
FIGS. 12A-C are various views of an exemplary embodiment of a paneling unit of the present invention.
Figure 12C:
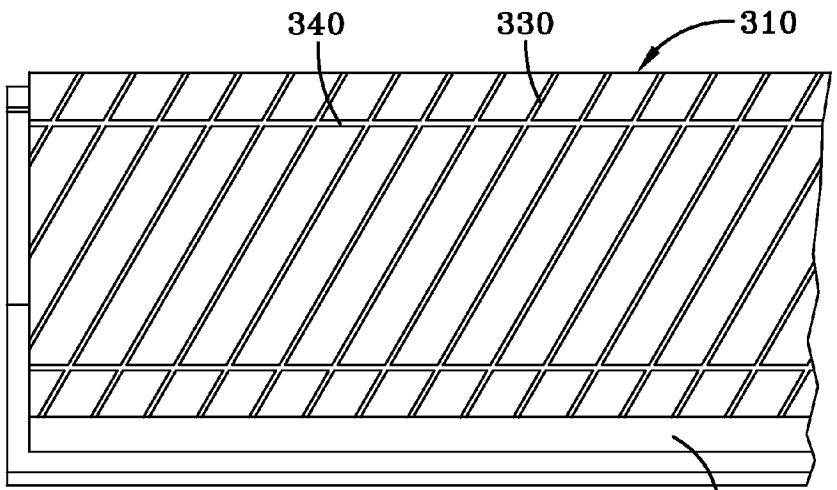
Figure 12B:
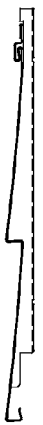

FIGS. 12A-C are various views of an exemplary embodiment of a paneling unit of the present invention. As may be observed in FIGS. 12A-C, a backing portion 310 of a paneling unit 300 is shown wherein the backing portion is comprised of a bottom portion defining a channel 320; a plurality of drainage grooves 330 on a surface 350 of the backing portion 310; and a pair of connector grooves 340 on the surface 350 of the backing portion 310. As shown, the generally horizontal connector grooves 340 intersect the plurality of drainage grooves 330. As is typical for an installed position of a paneling unit of the present invention, the paneling unit would be approximately vertical. As a result, the drainage grooves 330 as shown in this exemplary embodiment would be angled downward and thusly provide a drainage pathway for a liquid such as water, or an accumulation of water such as might be produced from condensation. As can be noted from the position of the generally horizontal connector grooves 340, the intersection of the connector grooves 340 with the drainage grooves 330 provides an alternate pathway for a liquid to drain. As a result, if a particular drainage groove 330 were plugged or obstructed, excess liquid may be diverted to drain through another drainage groove 330 by its transfer via an intersecting connector groove 340.

Figure 13:
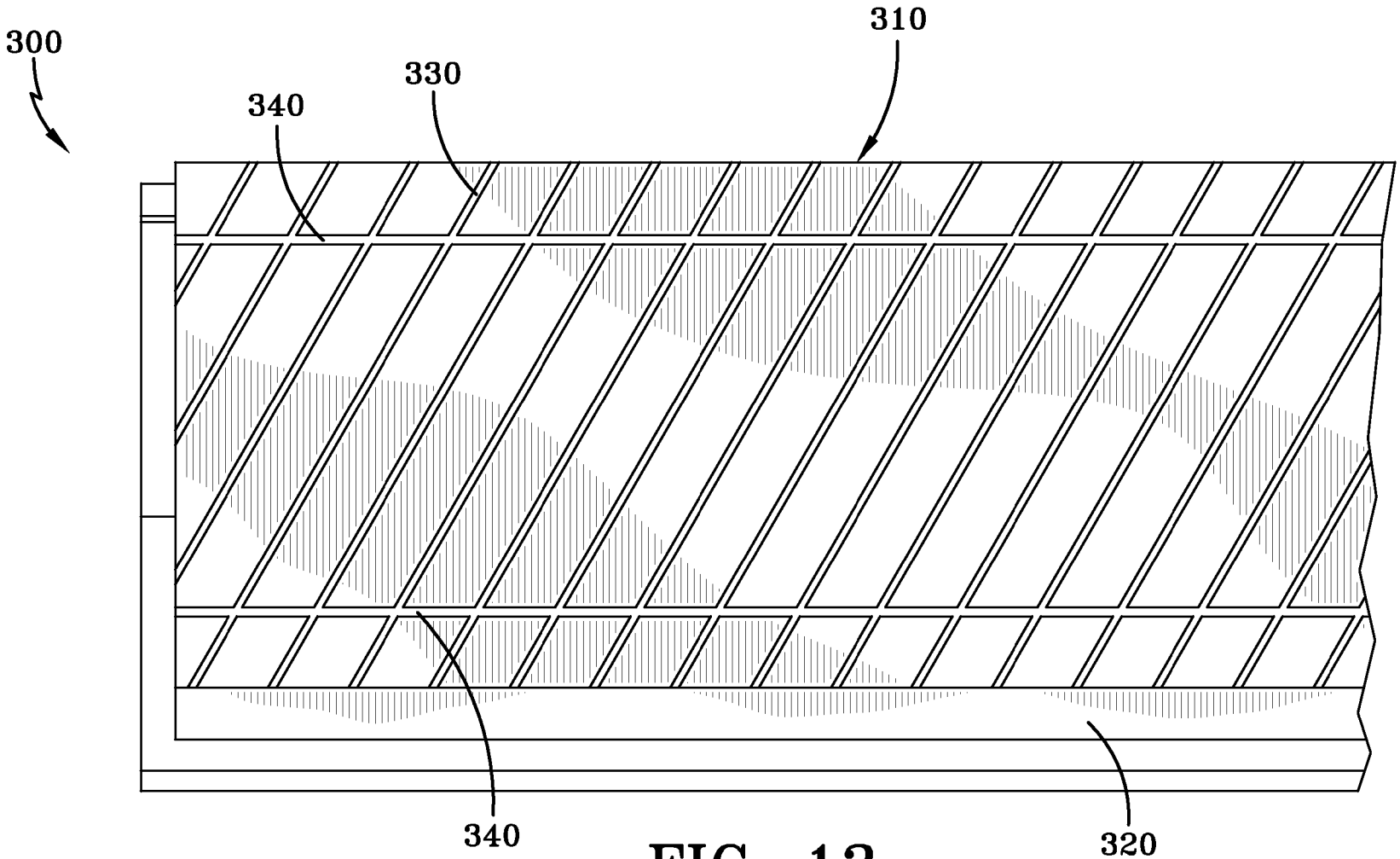
FIG. 13 is a rear elevational view of a portion of an exemplary embodiment of a paneling unit of the present invention.

As shown in FIGS. 12A-C, and with even greater detail in FIG. 13, an exemplary embodiment of a paneling unit of the present invention may have a plurality of drainage grooves 330 oriented at an angle of approximately 30° from vertical with respect to the longitudinal length of the drainage groove 330. Alternatively, the drainage grooves of other embodiments of the present invention may be placed at other angles on the surface of the backing portion. Preferred embodiments will typically have drainage grooves on the surface of the backing portion of the paneling unit in a generally downward trend so as to facilitate the drainage of liquid. Other alternative embodiments of the present invention may use drainage grooves that intersect other drainage grooves. In addition, alternative embodiments of the present invention may use patterns of drainage grooves not necessarily defined by straight lines that facilitate the drainage of liquid.

With regard to the connector grooves 340 as shown in FIGS. 12A-C and 13, the connector grooves are shown as being in a generally horizontal orientation. Alternative embodiments of the present invention allow for connector grooves to be generally oriented in any direction. It is preferred that at least one connector groove intersects at least two drainage grooves on a surface of a backing portion of a paneling unit. Generally, the relationship between a plurality of drainage grooves and at least one connector groove on a surface of a backing portion of a paneling unit is that the grooves are hydraulically connected.

Figure 14:
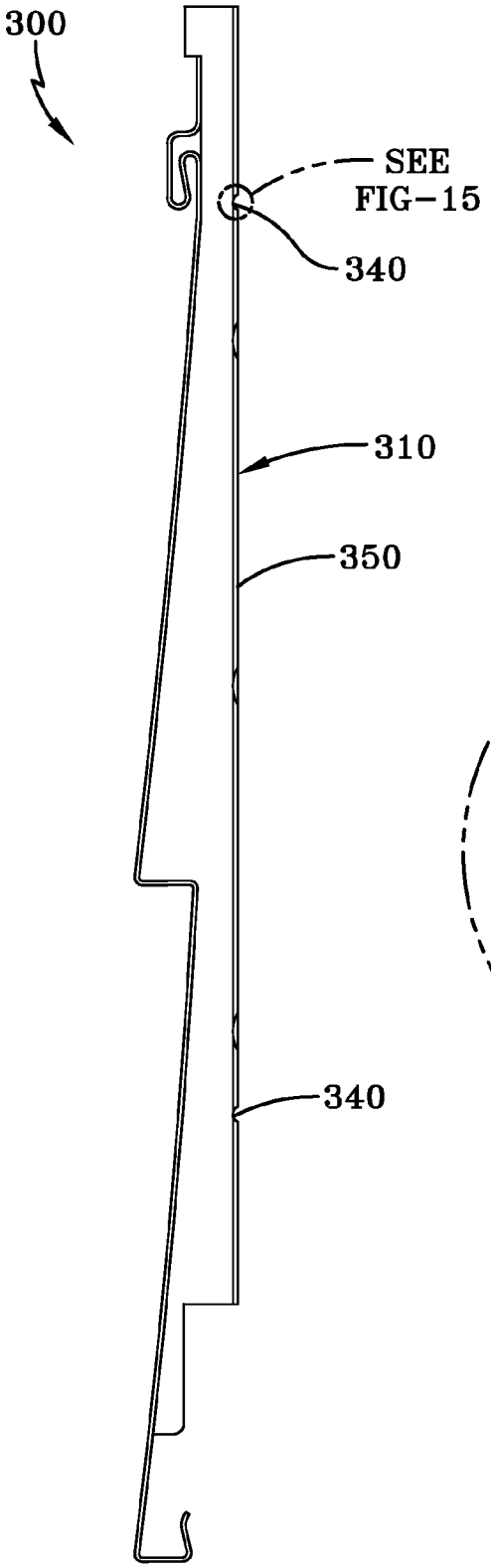
FIG. 14 is a side elevational view of an exemplary embodiment of a paneling unit of the present invention.

FIG. 14 is a side elevational view of an exemplary embodiment of a paneling unit of the present invention. This view of a preferred embodiment of the present invention shows a pair of generally horizontal connector grooves 340 on a surface 350 of a backing portion 310 of the paneling unit 300.

Figure 15:
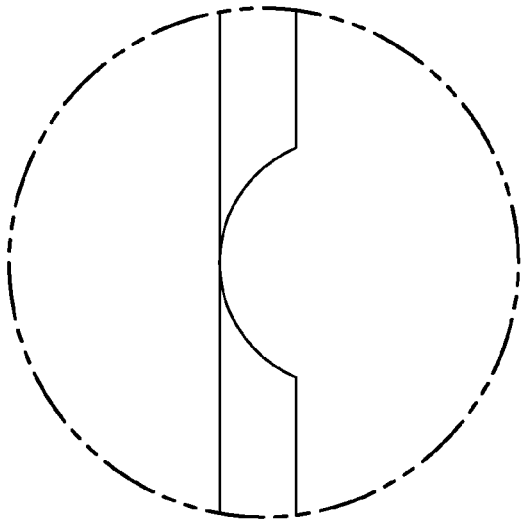
FIG. 15 is a side elevational view of a portion of an exemplary embodiment of a paneling unit of the present invention.

FIG. 15 is a side elevational view of a portion of an exemplary embodiment of a paneling unit of the present invention. Particularly, this view of an embodiment of the present invention is intended to show example dimensions and a shape for the connector grooves and the drainage grooves of the present invention. As shown, either type of groove is generally a curved groove having a depth of 0.0625 inches deep and 0.1875 inches wide into a surface of the backing portion of a panel. These dimensions may vary as needed. Typically, a groove would not be placed deep enough to penetrate the entire backing portion of a paneling unit. Instead, the generally preferred embodiment of the grooves of the present invention will be sized and placed so as to adequately allow a liquid to drain from the surface of the backing portion of the paneling unit.

The top or face portion of the paneling units may be smooth or may have any number of finishes that are typically known by those in the art of manufacturing paneling. The finish may add contour and texture to simulate the appearance of wooden paneling.

The paneling units of the present invention may be of various lengths, heights, and thicknesses. The particular dimensions of a panel of the present invention may be selected to suit a particular application. Some exemplary embodiments of a paneling unit of the present invention may be approximately 15 to 18 inches in height. However, as just mentioned, it should also be recognized that a paneling unit of the present invention may have any desired dimensions including a height up to or in excess of 50 inches.

The paneling units as described herein may be formed from a polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic materials), metals (such as aluminum or polymer coated metal), or other similar or suitable materials may also be used. The paneling may be molded, extruded, roll-formed from a flat sheet, or formed by any other suitable manufacturing technique.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

The invention claimed is:

1. A method for installing a paneling unit, said method comprising:

providing a siding panel comprised of:

(a) a tongue;

(b) a groove; and (c) multiple courses extending between said tongue and said groove;

securing a backing portion to said siding panel to form a unit, said backing portion comprised of:

(a) a front surface adjacent to said siding panel and substantially mating with said multiple courses of said siding panel;

(b) a plurality of drainage grooves on a rear surface such that said plurality of drainage grooves are oriented on said rear surface of said backing portion to provide a drainage or ventilation pathway;

(c) a top portion; and (d) a bottom portion defining a channel on said rear surface;

installing said unit on a building structure wherein at least a portion of said plurality of drainage grooves on said rear surface of said backing portion are adapted to form at least a segment of a substantially continuous drainage groove with a rear surface of a backing portion of an adjacent, substantially similar paneling unit when installed such that said tongue of said siding panel is adapted to be received in a groove of a siding panel of said adjacent, substantially similar paneling unit, and said top portion of said backing portion is adapted to be received in a channel of a bottom portion of a backing portion of said adjacent, substantially similar paneling unit.

2. The method of claim 1 wherein said plurality of drainage grooves are adapted to provide preferential pathways for drainage of a liquid in contact with said rear surface of said backing portion of said paneling unit.

3. The method of claim 1 wherein each of said plurality of drainage grooves extends from an edge of said backing portion to another edge of said backing portion.

4. The method of claim 1 wherein said rear surface of said backing portion is placed adjacent to said building structure.

5. The method of claim 1 wherein said orientation of said plurality of drainage grooves on said rear surface of said backing portion is generally downward relative to an installed position of said paneling unit.

6. The method of claim 1 wherein said orientation of said plurality of drainage grooves on said rear surface of said backing portion is approximately 30° from vertical along a length of said plurality of drainage grooves.

7. The method of claim 1 wherein each of said plurality of drainage grooves are approximately 0.0625 inches deep.

8. The method of claim 1 wherein each of said plurality of drainage grooves have a width of approximately 0.1875 inches.

9. The method of claim 1 wherein said backing portion is selected from the group consisting of foam, fiberglass, and cardboard.

10. The method of claim 9 wherein said foam is comprised of expanded or extruded polystyrene.

11. The method of claim 10 wherein said foam further comprises a chemical adapted to repel insects or bugs.

12. The method of claim 1 wherein said siding panel is comprised of plastic.

13. The method of claim 1 wherein said siding panel is comprised of a vinyl material.

14. The method of claim 1 wherein said siding panel is comprised of a plastic composite including cellulosic filler.

15. The method of claim 1 wherein said backing portion is further comprised of at least one connector groove on said rear surface that intersects at least two of said plurality of drainage grooves.

16. The method of claim 15 wherein said plurality of drainage grooves and said at least one connector groove on said rear surface of said backing portion are hydraulically connected.

17. The method of claim 15 wherein said at least one connector groove extends from an edge of said backing portion to another edge of said backing portion.

18. The method of claim 15 wherein at least a portion of said at least one connector groove on said rear surface of said backing portion is adapted to form at least a segment of a continuous connector groove with a rear surface of a backing portion of an adjacent, substantially similar paneling unit when installed.

19. The method of claim 15 wherein at least a portion of said plurality of drainage grooves and at least a portion of said at least one connector groove on said rear surface of said backing portion are adapted to form at least a segment of a continuous drainage groove and at least a segment of a continuous connector groove, respectively, with a surface of a backing portion of an adjacent, substantially similar paneling unit when installed.

20. The method of claim 15 wherein an orientation of said at least one connector groove on said rear surface of said backing portion is approximately horizontal along a length of said at least one connector groove.

21. The method of claim 1 wherein said siding panel is adhered to said backing portion.

22. The method of claim 1 wherein said orientation of said drainage grooves is at an angle from vertical.

23. The method of claim 1 wherein a width of said unit is substantially vertically oriented when installed on said building structure.

24. The method of claim 1 wherein:

said top portion of said backing portion extends above a top edge of said siding panel;

a bottom edge of said siding panel extends below said bottom portion of said backing portion;

said tongue of said siding panel extends downwardly when installed; and said groove of said siding panel extends upwardly when installed.

* * * * *